US005081875A

United States Patent [19]

Isozumi et al.

[11] Patent Number: 5,081,875

[45] Date of Patent: Jan. 21, 1992

[54] STARTER MOTOR

[75] Inventors: Shuzou Isozumi; Keiichi Konishi, both of Hyogo, Japan

[73] Assignee: Mitsubishi Denki K.K., Tokyo, Japan

[21] Appl. No.: 584,016

[22] Filed: Sep. 18, 1990

[30] Foreign Application Priority Data

Sep. 29, 1989 [JP] Japan ..... 1-252082
Nov. 1, 1989 [JP] Japan ..... 1-286195

[51] Int. Cl.[5] ..... F02N 11/00
[52] U.S. Cl. ..... 74/7 R; 74/6
[58] Field of Search ..... 74/6, 7 R

[56] References Cited

U.S. PATENT DOCUMENTS 4,800,766 1/1989 Isozumi et al. ..... 74/7 E
4,816,712 3/1989 Tanaka ..... 310/237
4,862,027 8/1989 Isozumi et al. ..... 310/99
4,941,366 7/1990 Isozumi ..... 74/6
4,962,340 10/1990 Isozumi ..... 74/7 R X
4,985,637 1/1991 Isozumi ..... 74/7 R X

FOREIGN PATENT DOCUMENTS 63-9066 1/1988 Japan .
63-90665 4/1988 Japan .

*Primary Examiner*—Allan D. Herrmann
*Assistant Examiner*—Julie Krolikowski
*Attorney, Agent, or Firm*—Sughrue, Mion, Zinn, Macpeak & Seas

[57] ABSTRACT

An engine starter comprises a DC motor having a hollow armature rotation shaft, a drive force transmitting device for transmitting a drive force generated by the DC motor, the drive force transmitting device includes a planetary gear speed reducer connected to the armature rotation shaft axially slidably received in a hollow portion of the armature rotation shaft, the output rotation shaft having a helical spline portion engaged with a helical spline portion of the overrunning clutch device, a pinion mounted on a front end of the output rotation shaft to engage a ring gear of an engine and spring device, provided adjacent to a side face of said pinion, for urging said pinion forwardly.

7 Claims, 6 Drawing Sheets

STARTER MOTOR

BACKGROUND OF THE INVENTION

This invention relates to a starter motor used mainly for starting an engine of a vehicle.

FIG. 1 is a cross-sectional view of a portion of a conventional starter motor disclosed, for example, in Japanese Patent Application Unexamined Publication No. sho. 63-90665. This starter motor is of the coaxial type in which an armature rotation shaft 3 of a DC motor 2, an output rotation shaft 4 having a pinion 5 fixedly mounted on its front end (right end in the drawings), and an electromagnetic switch device (not shown) are disposed on a common axis. More specifically, the armature rotation shaft 3 is hollow, and a plunger rod 105 of the electromagnetic switch device disposed rearwardly of the DC motor 2 is extended into an internal passage 3*a* of the armature rotation shaft 3. The output rotation shaft 4 is received in a front end portion of the internal passage 3*a*, and the plunger rod 105 is abutted against the rear end face of the output rotation shaft 4 through a steel ball 106. Upon forward movement of the plunger rod 105, the output rotation shaft 4 is urged or pushed forwardly.

The output rotation shaft 4 has at its front end (right end) the pinion-5 meshingly engageable with a ring gear of the engine (not shown in the drawing), and the rear portion of the output rotation shaft 4 is inserted in the internal passage 3*a* of the armature rotation shaft 3. This inserted portion 4*a* is borne by a sleeve bearing 6 fixedly fitted in the internal passage 3*a*, so that the output rotation shaft 4 is slidable axially. Means for transmitting a drive force from the armature rotation shaft 3 of the DC motor 2 to the axially-slidable output rotation shaft 4 is constituted by a drive force transmitting device 8 including an overrunning clutch device (one-way clutch) 7. Interposed between the inner peripheral portion (disposed inwardly of the pinion teeth) of the pinion 5 and the output rotation shaft 4 is a pinion spring 10 which normally urges the pinion in a forward direction.

More specifically, the drive force transmitting device 8 comprises a planetary gear speed reducer 9 including a sun gear 9*a* formed on the outer periphery of the armature rotation shaft 3 as well as planetary gears 9*b*, and the above-mentioned one-way clutch device 7 which includes a clutch outer member 7*a* to which central support shafts 9*c* for the planetary gears 9*b* are fixedly secured, and a clutch inner member 7*b* having at its inner peripheral surface helical spline grooves 109*d* meshed with a helical spline portion 4*c* formed on an outer periphery of an enlarged-diameter portion 4*b* of the output rotation shaft 4. Reference numeral 11 denotes a pinion stopper.

In the above conventional starter device of the coaxial type, when it is intended to reduce the size of the DC motor, it is considered that this can be achieved by reducing the number of the teeth of the pinion to increase the reduction ratio between the ring gear and the pinion. In this case, in the conventional device, the pinion spring is provided between the inner peripheral portion T of the pinion and the output rotation shaft in radially overlapping relation, and therefore with the construction of FIG. 1, if the number of the teeth of the pinion is reduced, there is encountered a problem that the mechanical strength (i.e., the strength of the inner peripheral portion T of the pinion and the strength of the shaft) is reduced.

On the other hand, the sun gear 9*a* of the planetary gear speed reducer 9 is formed on the front end of the armature rotation shaft 3. The planetary gear speed reducer 9 comprises the sun gear 9*a*, an inner gear 107*b* formed on an inner peripheral surface of a front bracket 108, and the planetary gears 9*b* rotatably supported by the respective central support shafts 9*c* and meshed with the sun gear 9*a* and the inner gear 107*b*.

The central support shafts 9*c* of the planetary gear speed reducer 9 are fixedly secured to the clutch outer member 7*a* of the overrunning clutch device 7, so that a reduction output of the armature rotation shaft 3 can be transmitted to the overrunning clutch device 7. The clutch inner member 7*b* is provided inwardly of the clutch outer member 7*a*, and rollers 109*c* are provided between the clutch outer 7*a* and inner members 7*b*, and these parts constitute the overrunning clutch device 7. Formed in the inner peripheral surface of the clutch inner member 7*b* are the helical spline grooves 109*d* meshed with the helical spline portion 4*c* formed on the enlarged-diameter portion 4*b* of the output rotation shaft 4. A return spring 110 is provided between a stepped portion 109*e* on the front end of the clutch inner member 7*b* and the helical spline portion 4*c*, and urges the output rotation shaft 4 rearwardly. The front end of the clutch inner member 7*b* is supported by a bearing 111 fitted in the front bracket 108.

The pinion 5 is spline-connected to a straight spline formed on the front end of the output rotation shaft 4, and a forward movement of the pinion 5 is limited by the stopper 11. The pinion spring 10 is provided inwardly of the inner periphery of the pinion 5, and acts between the pinion 5 and a stepped portion 104*b* on the output rotation shaft 4, the pinion spring 10 urging the pinion 5 forwardly. The pinion spring 10 is provided in order to normally urge the pinion 5 forwardly after the stopper 11 is fixed in position and also to dampen an impact produced when the pinion 5 is abutted against the ring gear. The bearing 6 is mounted within the internal passage 3*a* of the armature rotation shaft 3, and supports the rear portion of the output rotation shaft 4.

In the coaxial-type starter motor of the above construction, the rotational drive force of the DC motor 2 is transmitted to the overrunning clutch device 7 via the planetary gear speed reducer 9, and is further transmitted to the output rotation shaft 4 spline-fitted in the clutch inner member 7*b*. At this time, the plunger rod 105 is driven forwardly to move the output rotation shaft 4 forwardly, so that the pinion 5 is brought into meshing engagement with the ring gear (not shown) of the engine, thereby starting the engine. After the engine starts, when the operator (driver) turns off the electromagnetic switch device, the plunger rod 105 is retracted, and the output rotation shaft 4 is returned to the original position (stationary position) under the influence of the return spring 110, so that the pinion 5 is disengaged from the ring gear. A reverse drive, applied from the engine immediately after the start of the engine, is prevented by the one-way clutch operation of the overrunning clutch device 7 from being transmitted to the DC motor 2.

The conventional starter motor is of the above construction, and the front portion of the output rotation shaft 4 is supported by the spline-fitting between the helical spline grooves 109*d* of the clutch inner member 7*b* and the helical spline portion 4*c*. However, with respect to the helical spline fitting, it is difficult to extremely reduce a clearance in the fitting portion from the viewpoint of ensuring a sliding ability. Therefore, a play of a certain amount is present between the output rotation shaft 4 and the clutch inner member 7*b*, and moreover since the fitting portion serving as the support portion is not provided at the front end portion of the clutch inner member 7*b*, the distance between this fitting portion and the pinion 5 is large, and hence a moment is large. As a result, because of such a play and such a large moment, the conventional starter motor has problems that abnormal noises are produced and that in the worst case, the output rotation shaft 4 is broken. Further, the helical spline grooves 109*d* not only receive the load but also serve as the sliding surface for the output rotation shaft 4, and therefore depending on the determined value of the clearance, this has often been a factor in an improper sliding of the output rotation shaft 4 because of deterioration of grease on the spline fitting portion and of the deposition of dust on this portion.

SUMMARY OF THE INVENTION

With the above problems in view, it is an object of this invention to provide a coaxial-type starter device which can be of a small-size without reducing the strength of the inner peripheral portion of the pinion and the strength of the shaft.

In a coaxial-type starter device according to the present invention, an output rotation shaft extends through a sleeve which constitutes one end portion of a clutch inner member and is supported on a housing via a bearing. The output rotation shaft has a spline portion engaged with a helical spline formed on the inner surface of the sleeve. A pinion spring is disposed rearwardly of a pinion, and in a stationary condition of the pinion, at least part of the pinion spring is so disposed as to radially overlap a cylindrical inner surface of the front end of the sleeve supporting the output rotation shaft.

More specifically, according to the present invention, there is provided a coaxial-type starter device comprising a DC motor having a hollow armature rotation shaft; a drive force transmitting device including a planetary gear speed reducer connected to said armature rotation shaft, and an overrunning clutch device; an output rotation shaft having a helical spline portion engaged with helical spline grooves formed in an inner peripheral surface of a clutch inner member of said overrunning clutch device, said output rotation shaft being axially slidably received in a hollow portion of said armature rotation shaft; and a pinion mounted on a front end of said output rotation shaft so as to be brought into and out of engagement with a ring gear of an engine; CHARACTERIZED in that said clutch inner member is extended to form a sleeve which has at its front end a cylindrical inner surface which supports said output rotation shaft; a pinion spring is provided adjacent to a rear surface of a tooth portion of said pinion to urge said pinion forwardly; and in a stationary condition of said pinion, at least part of said pinion spring is so disposed as to radially overlap said cylindrical inner surface of said sleeve.

In another example of a starter motor of the present invention, a tubular member is integrally formed with a pinion, and the inner periphery of the tubular member is disposed in sliding contact with an output rotation shaft whereas the outer periphery of the tubular member is disposed in sliding contact with a front portion of a clutch inner member.

More specifically, according to another aspect of the invention, there is provided a starter motor comprising an overrunning clutch device to which a drive force of the motor is transmitted; an output rotation shaft fitted by with helical splines in an inner periphery of a clutch inner member serving as an output side portion of said overrunning clutch device, in such a manner that said output shaft is movable axially; and a pinion mounted on a front portion of said output rotation shaft so as to be brought into and out of engagement with a ring gear of an engine; CHARACTERIZED in that there is provided a tubular member integrally formed with said pinion, an outer peripheral surface of said tubular member being disposed in sliding contact with that portion of the inner peripheral surface of said clutch inner member disposed forwardly of a helical spline fitting portion of said clutch inner member, and an inner peripheral surface of said tubular member being disposed in sliding contact with said output rotation shaft.

DESCRIPTION OF THE PREFERRED EMBODIMENTS OF THE INVENTION

Figure 2:
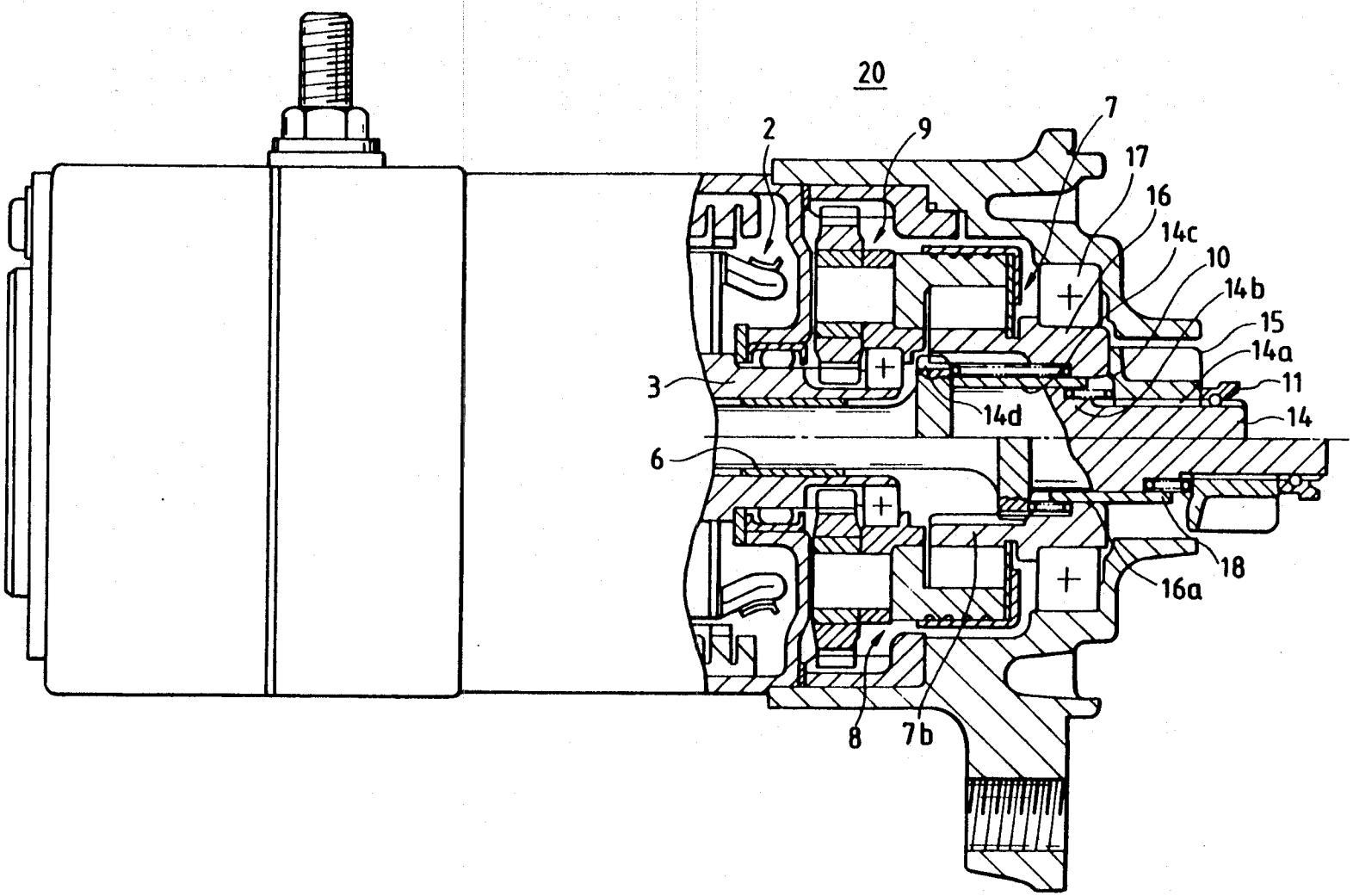
FIG. 2 is a partly cross-sectional, front-elevational view of a portion of a first embodiment of the present invention.

FIG. 2 shows a preferred embodiment of a coaxial-type starter device 20 of the present invention. A pinion 15 is mounted on a straight spline portion 14*a* formed on a front end portion of an output rotation shaft 14. A pinion spring 10 is provided in a space formed by a stepped portion 14*b* on the output rotation shaft 14 and a rear surface of the pinion 15, the diameter of the stepped portion 14*b* being substantially equal to the outer diameter of the straight spline portion 14*a*. A sleeve 16, constituting one end of a clutch inner member 7*b* of an overrunning clutch 7, is supported at an outer periphery of its front end by a bearing 17. A cylindrical inner peripheral surface 16*a* of the sleeve 16 supports the output rotation shaft 14. A helical spline portion 14*d* of the output rotation shaft 14 is engaged with helical spline grooves formed in the sleeve 16.

A bushing 18 is press-fitted on a cylindrical portion 14*c* of the output rotation shaft 14, and an outer peripheral surface of the bushing 18 is slidable relative to the sleeve inner peripheral surface 16*a*.

Figure 1:
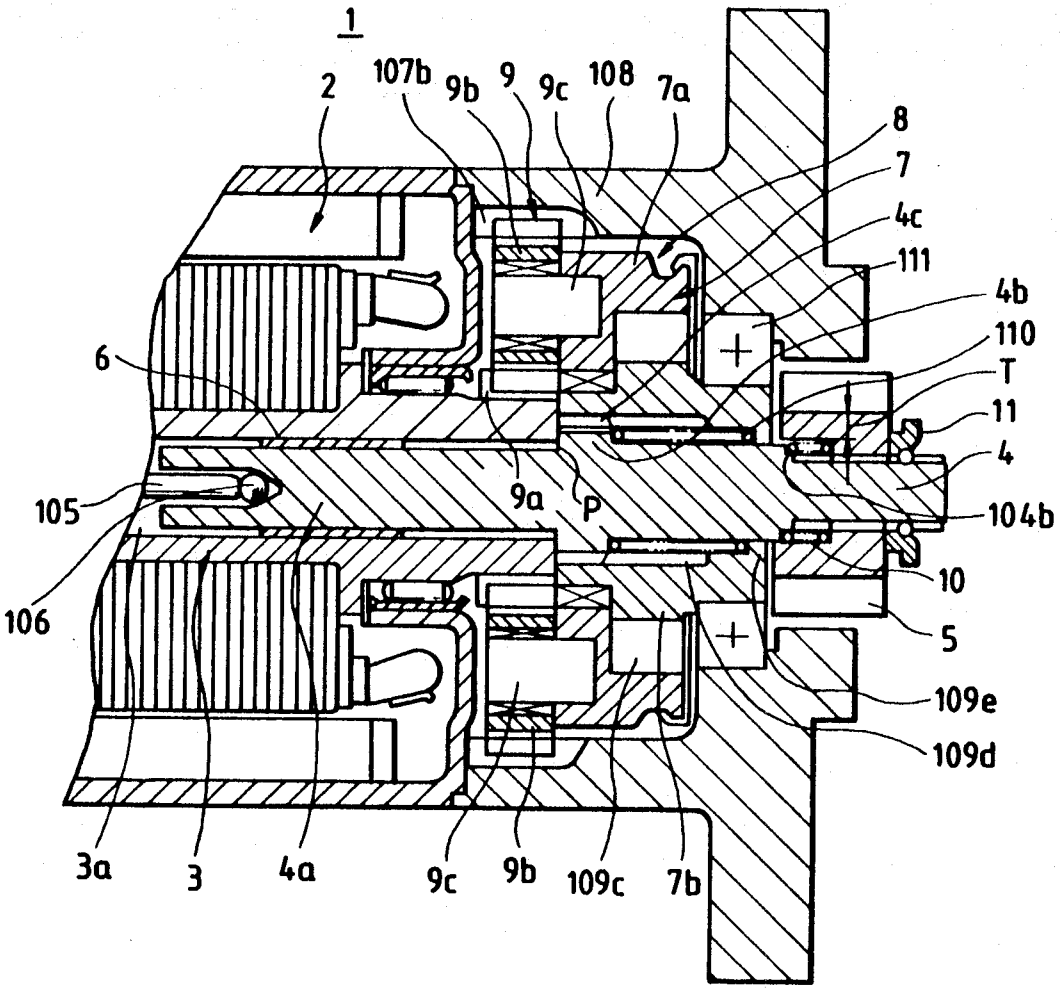
FIG. 1 PRIOR ART
FIG. 1 is a cross-sectional view of a portion of the conventional starter motor.

Other portions corresponding respectively to those portions of FIG. 1 are denoted respectively by identical reference numerals.

In the above construction, as is not the case with the conventional device, the pinion spring is not disposed at the inner peripheral portion of the pinion, but is disposed in the annular space formed by the rear surface of the pinion 15 and the stepped portion 14*b* of the output rotation shaft 14. Also, in a stationary condition of the pinion (shown at an upper half of FIG. 2), at least part of the pinion spring 10 radially overlaps the inner peripheral surface 16*a* of the sleeve 16, and therefore the axial length can be reduced. In addition, even if the number of the teeth of the pinion 15 is reduced, the strength of the inner peripheral portion of the pinion and the strength of the shaft are not reduced. More specifically, if the tooth configuration has a level represented by M (module)=2.5, the number of teeth which has conventionally been 8 at the best can be reduced to 7 in the present invention.

Further, since one end of the output rotation shaft 14 is supported by the cylindrical surface, a clearance between the sliding portions can be easily reduced, so that the tilting of the output rotation shaft is prevented, thereby minimizing the deterioration of the intermeshing between the pinion and the ring gear.

Figure 3:
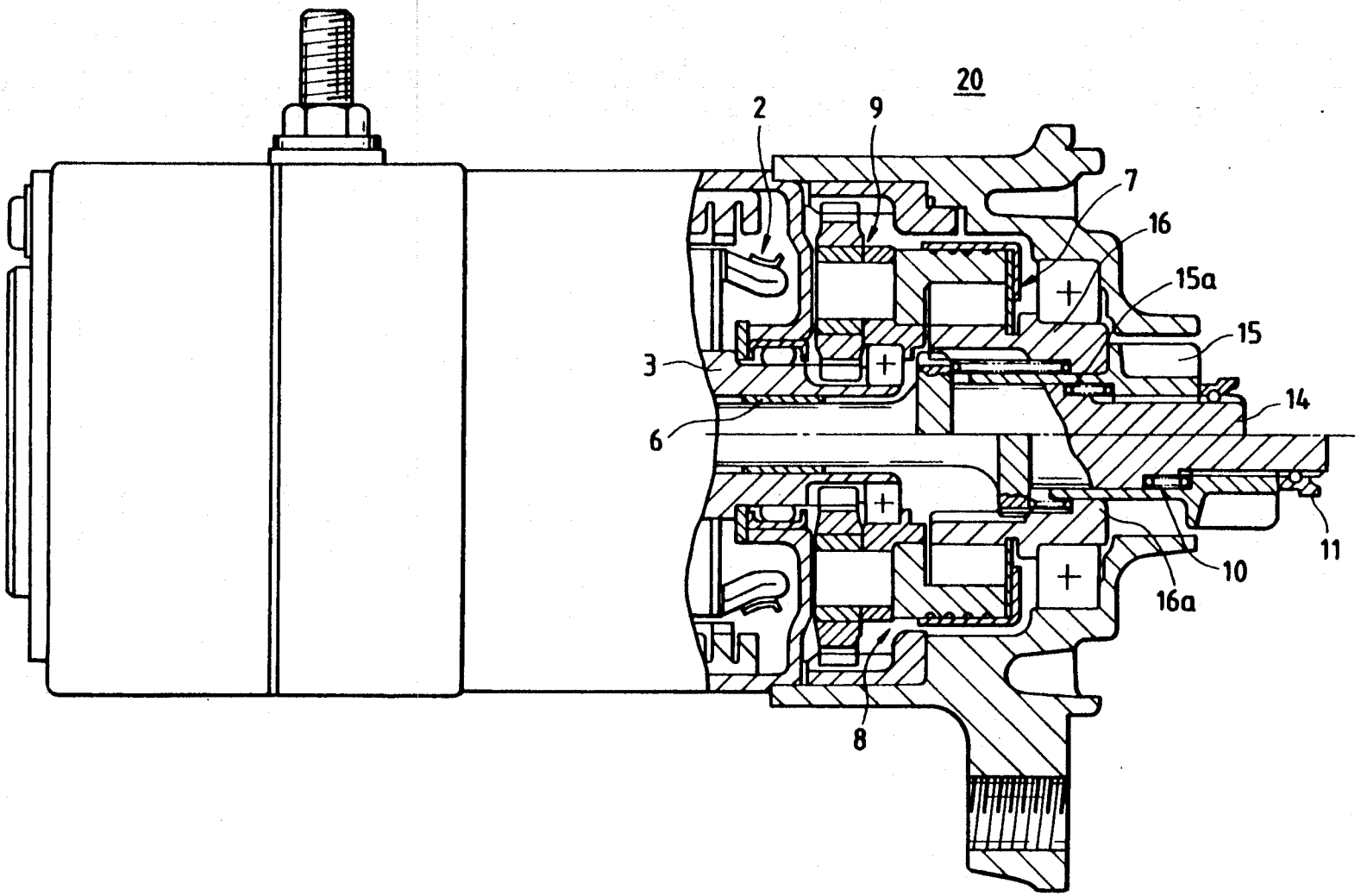
FIGS. 3 and 4 are partly cross-sectional, front-elevational views of second and third embodiments of the present invention, respectively.

FIG. 3 shows a second embodiment of the invention in which a cylindrical portion 15*a* is formed integrally with the rear of a pinion 15, and an outer peripheral surface of the cylindrical portion 15*a* is slidable relative to the inner peripheral surface 16*a* of the sleeve 16. This embodiment achieves similar effects.

Figure 4:
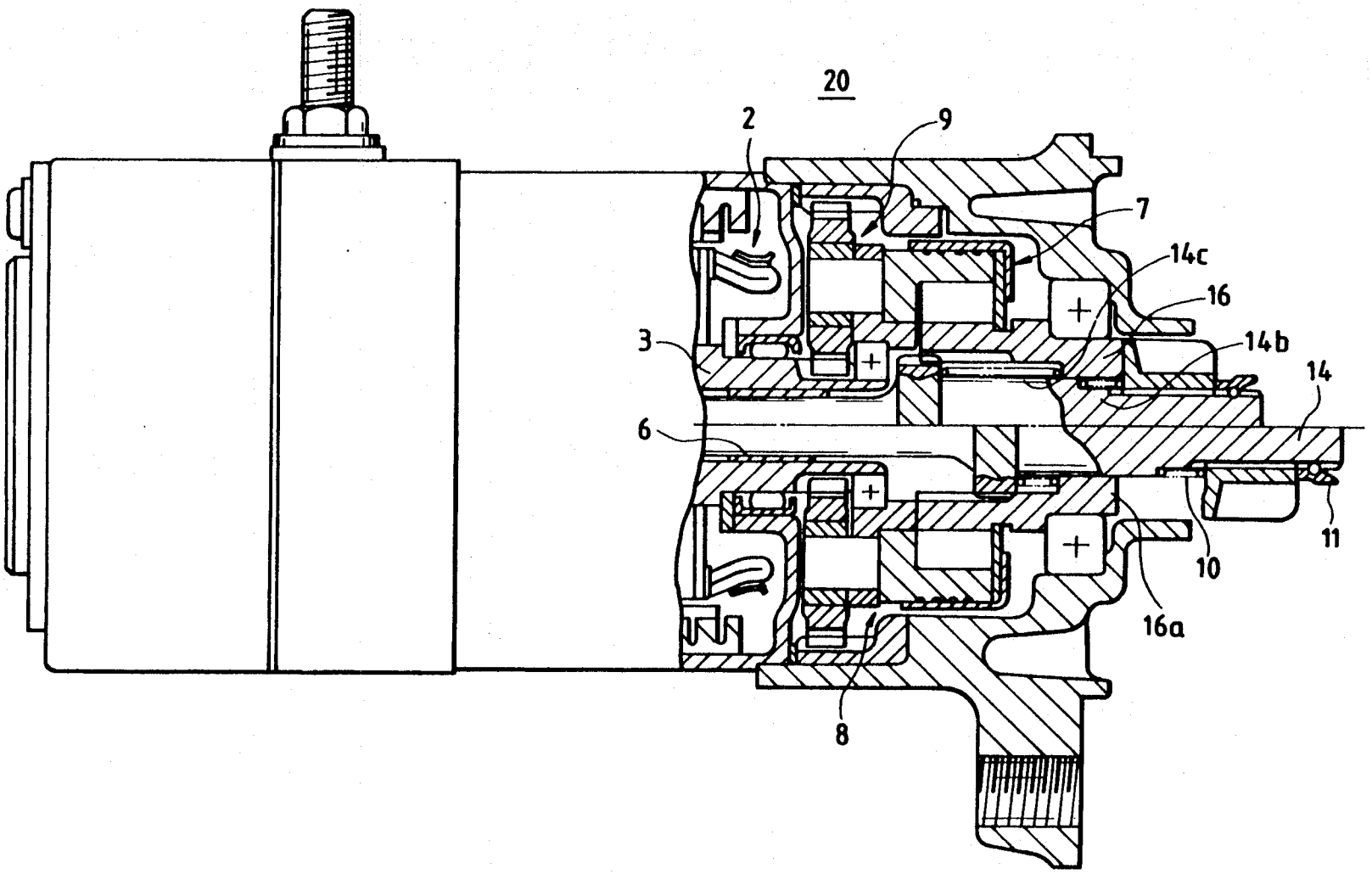

FIG. 4 shows a third embodiment of the invention in which in the stationary condition of the pinion, the pinion spring 10 radially overlaps the inner peripheral surface 16*a* of the sleeve 16, and the cylindrical portion 14*c* of the output rotation shaft 14 is disposed in direct sliding contact with the inner peripheral surface 16*a*.

As is clear from the foregoing, in the present invention, the pinion spring, the pinion and the pinion stopper are mounted in this order on the front end portion of the output rotation shaft slidable relative to the inner peripheral surface of the sleeve provided at one end of the overrunning clutch. In the stationary condition of the pinion, at least part of the pinion spring radially overlaps the output rotation shaft-supporting portion provided on the sleeve. With this construction, without reducing the strength of the inner peripheral portion of the pinion and the strength of the shaft, the DC motor can advantageously be of a small size. Further, the working is facilitated, so that the clearance between the sliding portions can be reduced, and therefore advantageously, the tilting of the output rotation shaft is prevented, and a good intermeshing between the pinion and the ring gear is achieved.

In this invention, the pinion spring is disposed rearwardly of the rear surface of the pinion, and therefore even if the reduction ratio between the ring gear and the pinion is increased by reducing the number of the teeth of the pinion, the strength of the inner peripheral portion of the pinion and the strength of the shaft will not be reduced.

Figure 5:
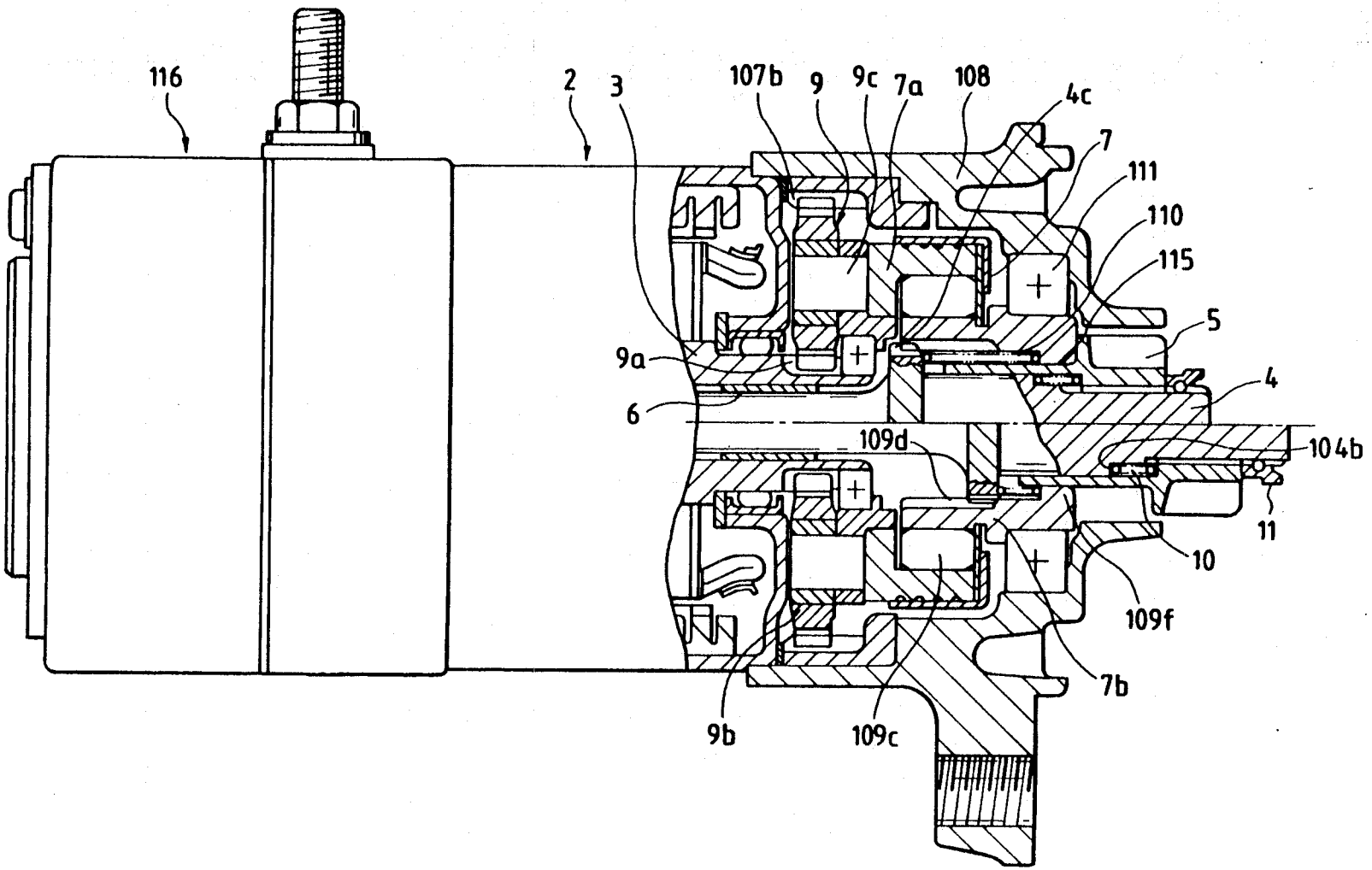
FIG. 5 is a partly cross-sectional, front-elevational view of a fourth embodiment of a starter motor of the present invention.

FIG. 5 shows a fourth embodiment of a starter motor of the present invention. Reference numerals 1 to 14 in FIG. 5 and FIG. 1 denote corresponding portions, and therefore explanation of such corresponding portions is omitted here. A tubular portion 115 is extended integrally from a rear end of a pinion 5. The diameter of the inner peripheral surface of the tubular portion 115 is so determined as to provide such a clearance between this inner peripheral surface and an output rotation shaft 4 that the output rotation shaft 4 is slidable relative to the inner peripheral surface of the tubular portion 115. The outer peripheral surface of the tubular portion 115 is disposed in sliding contact with an inner peripheral surface of a support portion 109*f* formed on a front end of a clutch inner member 7*b*. A return spring 110 is provided between the rear end of the support portion 109*f* disposed outwardly of the tubular portion 115 and a front end of a helical spline portion 4*c* of the output rotation shaft 4. A pinion spring 10 is provided between the rear surface of the pinion 5 disposed inwardly of the tubular portion 115 and a stepped portion 104*b* on the output rotation shaft 4. An electromagnetic switch device 116 is provided adjacent to a rear end of a DC motor 2.

In the starter motor of the above construction, the output rotation shaft 4 is slidably supported by the support portion 109*f* of the clutch inner member 7*b* via the tubular portion 115, and therefore a clearance between the sliding portions of the clutch inner member 7*b* and the output rotation shaft 4 is small, and the output rotation shaft 4 is hardly shaken. Further, since the output rotation shaft 4 is supported at the front end of the clutch inner member 7*b*, and the distance between this support portion and the pinion 5 is small, and therefore a moment of the output rotation shaft 4 is small. In addition, since the supported tubular portion 115 is integral with the pinion 5, the pinion 5 itself is supported by the clutch inner member 7*b*, and therefore a play is not produced when the pinion 5 is meshed with the ring gear, and the eccentricity is prevented.

Further, in this embodiment, the pinion spring 10 is disposed rearwardly of the pinion 5, the inner peripheral portion of the pinion 5 can be reduced further as compared with the prior art in which the pinion spring 10 is disposed inwardly of the inner periphery of the pinion 5. This enables the number of the teeth of the pinion 5 to be reduced. Namely, conventionally, since the pinion spring 10 is disposed inwardly of the inner periphery of the pinion 5, it has been difficult to reduce the number of the teeth of the pinion 5 to less than a predetermined value, because the strength of the inner peripheral portion of the pinion must be ensured. In this embodiment, however, since the pinion spring 10 is not disposed inwardly of the inner periphery of the pinion 5, the diameter of the inner peripheral portion of the pinion can be reduced while keeping the strength of the inner peripheral portion of the pinion, and as a result the number of the teeth of the pinion can be reduced. More specifically, if the tooth configuration has a level represented by M (module)=2.54, the number of teeth which has conventionally been 8 at the best can be reduced to 7 in the present invention. Therefore, the reduction ratio between the ring gear and the pinion 5 can be increased, so that the relative torque is increased, which enables a small size of the starter motor.

In this embodiment, the engine starter operation is the same as that of the prior art, and its explanation is omitted here. In FIG. 5, the upper side above the center line represents the stationary condition, and the lower side represents the operative condition after the movement of the pinion 5 is completed.

Figure 6:
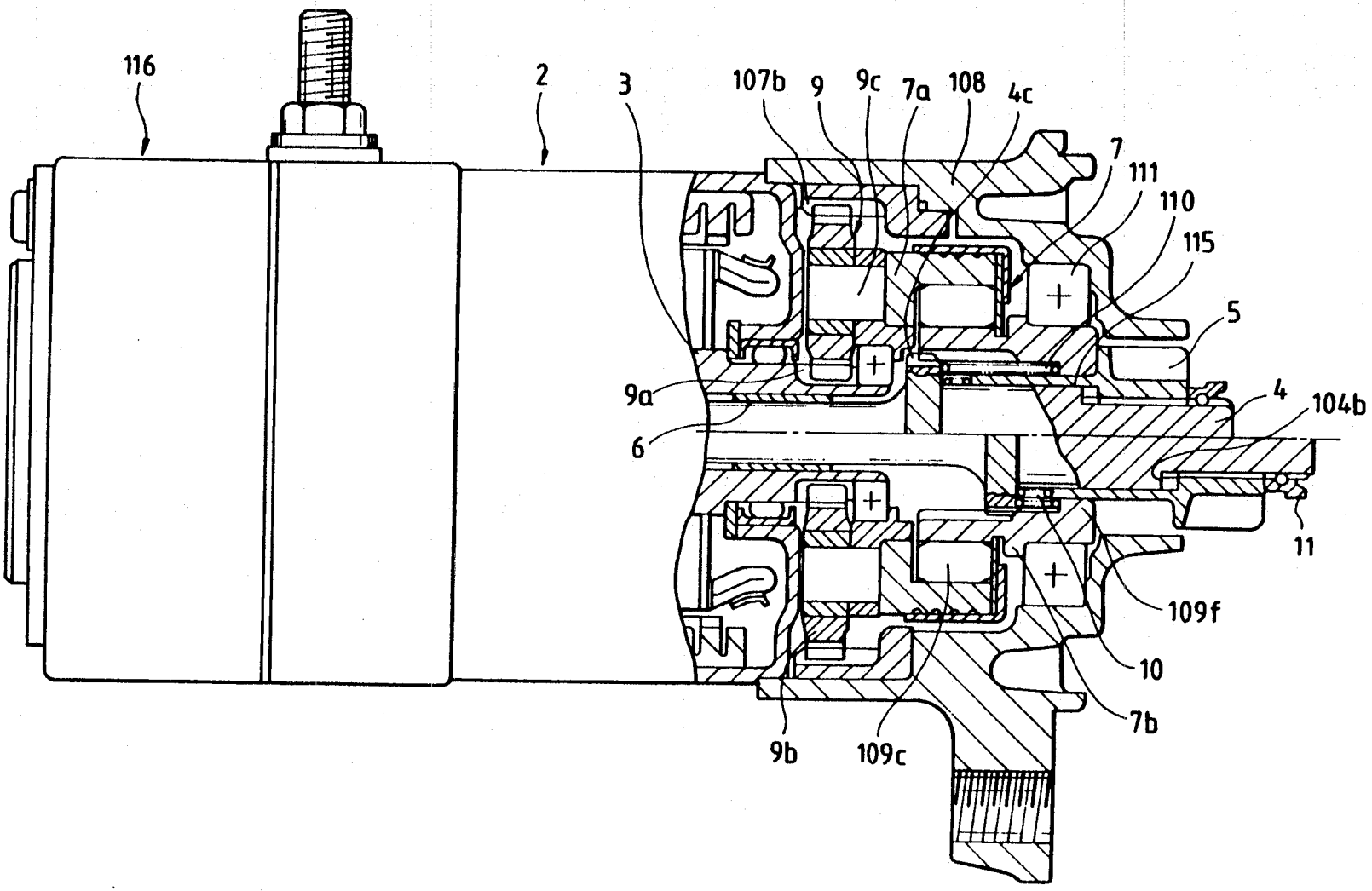
FIG. 6 is a partly cross-sectional, front-elevational view of a fifth embodiment of a starter motor of the present invention.

FIG. 6 shows a fifth embodiment of the invention. In this embodiment, the pinion spring 10 is provided between the rear surface of the tubular portion 115 and a front end surface of a helical spline portion 4*c* of an output rotation shaft 4. Except for this, the construction and operation of this embodiment are the same as those of the preceding embodiment, and this embodiment achieves the effects similar to those of the preceding embodiment.

In the above embodiments, although the support portion 109*f* of the clutch inner member 7*b* is in direct sliding contact with the tubular portion 115, a thin bearing may be interposed therebetween, in which case the sliding ability of the tubular portion 115 is enhanced.

Further, the tubular portion 115 may not be formed integrally with the pinion 5, and instead the tubular portion may be separate from the pinion 5 and may be combined with the pinion 5.

Further, although the above embodiments are directed to the coaxial-type starter motor in which the electromagnetic switch device 116 is disposed rearwardly of the DC motor 2, the present invention is not restricted to such embodiments. For example, the present invention may be directed to a starter motor of the type in which the electromagnetic switch device and the motor portion are disposed parallel to each other, and a starter motor of the inertia sliding type having no electromagnetic switch device. Further, although the starter motors of the above embodiments include the planetary gear speed reducer 9, the starter motors achieve similar effects even if they are not provided with such a speed reducer.

As described above, in the present invention, the tubular member is formed integrally with the pinion, and the output rotation shaft is supported on the front portion of the clutch inner member via the tubular member. Therefore, there is almost no play between the output rotation shaft and the clutch inner member, and a moment between the pinion and the support portion is small, and therefore advantageously the production of abnormal noises and the breakage of the output rotation shaft are prevented.

Further, since the output rotation shaft is supported by the clutch inner member not only through the helical spline fitting portion but also through the tubular member, there is almost no play between the clutch inner member and the output rotation shaft. Also, since its support portion is disposed forwardly of the helical spline fitting portion, the moment of the output rotation shaft is small.

What is claimed is:

1. An engine starter comprising:

a DC motor having a hollow armature rotation shaft;

drive force transmitting means for transmitting a drive force generated by said DC motor, said drive force transmitting means including a planetary gear speed reducer connected to said armature rotation shaft and an overrunning clutch device;

an output rotation shaft axially slidably received in a hollow portion of said armature rotation shaft, said output rotation shaft having a helical spline portion engaged with a helical spline portion of said overrunning clutch device;

a pinion, adapted to be engaged with a ring gear of an engine, mounted on a front end of said output rotation shaft; and spring means, provided rearwardly of a rear face of said pinion, for urging said pinion forwardly.

2. An engine starter as claimed in claim 1, further comprising an annular space formed by said rear face of said pinion and a stepped portion of said output rotation shaft, said spring means provided in said annular space.

3. An engine starter as claimed in claim 1, further comprising:

supporting means for supporting said output rotation shaft.

4. An engine starter as claimed in claim 3, wherein said supporting means includes a sleeve having at its front end a cylindrical inner surface, said sleeve is formed by extending an inner member of said clutch.

5. An engine starter as claimed in claim 3, wherein said supporting means includes an output rotation shaft-supporting portion, and wherein, in a stationary condition of said pinion, at least a portion of said spring means radially overlaps said output rotation shaft-supporting portion of said supporting means.

6. An engine starter comprising:

a DC motor having a hollow armature rotation shaft;

drive force transmitting means for transmitting a drive force generated by said DC motor, said drive force transmitting means including a planetary gear speed reducer connected to said armature rotating shaft and an overrunning such device;

an output rotation shaft axially slidably received in a hollow portion of said armature rotation shaft, said output rotation shaft having a helical spline portion engaged with a helical spline portion of said overrunning clutch device;

a pinion, adapted for use with a ring gear of an engine, mounted on a front end of said output rotation shaft to engage said ring gear of an engine;

spring means, provided rearwardly of a rear face of said pinion, for urging said pinion forwardly; and supporting means for supporting said output rotation shaft;

wherein said supporting means includes a tubular member integrally formed with said pinion, and an inner peripheral surface of said tubular member disposed in sliding contact with said output rotation shaft.

7. An engine starter as claimed in claim 6, wherein said tubular member has an outer peripheral surface disposed in sliding contact with a portion of said inner peripheral surface of said clutch inner member disposed forwardly of said helical spline fitting portion of said clutch inner member, and said inner peripheral surface of said tubular member is disposed in sliding contact with said output rotation shaft.

* * * * *